US010456646B2

(12) United States Patent
English

(10) Patent No.: US 10,456,646 B2
(45) Date of Patent: Oct. 29, 2019

(54) BASEBALL BATTING TRAINING AID AND METHOD

(71) Applicant: Aaron Paramore English, Dahlonega, GA (US)

(72) Inventor: Aaron Paramore English, Dahlonega, GA (US)

( * ) Notice: Subject to any disclaimer, the term of this patent is extended or adjusted under 35 U.S.C. 154(b) by 0 days.

(21) Appl. No.: 15/876,717

(22) Filed: Jan. 22, 2018

(65) Prior Publication Data

US 2019/0224548 A1 Jul. 25, 2019

(51) Int. Cl.
*A63B 69/00* (2006.01)

(52) U.S. Cl.
CPC ..... *A63B 69/0059* (2013.01); *A63B 69/0002* (2013.01); *A63B 2069/0008* (2013.01); *A63B 2225/09* (2013.01)

(58) Field of Classification Search
CPC ..... A63B 69/0059; A63B 69/0002; A63B 2069/0008; A63B 2225/09; A63B 71/12; A63B 71/0605; F41H 1/02; A41D 13/015
USPC ..... 473/422, 450, 458, 464, 207–216; 2/2.5, 2/44–45, 92, 312, 102–105, 463; 428/911, 51, 148, 83; D29/100, 10–11, D29/101.4, 199
See application file for complete search history.

(56) References Cited

U.S. PATENT DOCUMENTS 1,163,094 A * 12/1915 Kurek ..... F41H 1/02 2/2.5
3,125,762 A * 3/1964 Glahe ..... A41D 13/0156 2/461
3,162,861 A * 12/1964 Gustafson ..... A63B 71/12 2/463
3,559,210 A * 2/1971 Hansen ..... F41H 5/0428 2/2.5
4,272,847 A * 6/1981 Buhler ..... A63B 71/12 2/461
4,497,069 A * 2/1985 Braunhut ..... F41H 1/02 2/2.5
D277,808 S * 3/1985 Nichols ..... D10/109.1
4,674,394 A * 6/1987 Martino ..... F41H 5/08 109/49.5
4,826,165 A 5/1989 Socci
(Continued)

FOREIGN PATENT DOCUMENTS

WO WO2015021495 A1 2/2015
WO WO2016114711 A1 7/2016
WO WO2017127348 A3 7/2017

*Primary Examiner* — Mitra Aryanpour
(74) *Attorney, Agent, or Firm* — Mitch Harris, Atty at Law, LLC; Andrew M. Harris

(57) ABSTRACT

A baseball and softball training aid is worn to prevent a batter's lead arm from extending too far backward in rotation during swing windup, thus collapsing the "box" or "barrel" referred to in batting training that exists between the batter's lead arm and chest during at least an initial portion of a swing of a bat. The training aid has a vertical stop providing a surface that is aligned vertically along a chest of the batter so that the lead arm of the batter is prevented from traveling past the vertical stop by contacting the vertical stop when the batter winds up to strike a ball and a pair of braces rigidly coupled to the vertical stop and extending across the chest of the batter to transfer energy from the vertical stop to the chest of the batter when the lead arm of the batter contacts the vertical stop.

18 Claims, 11 Drawing Sheets

(56) References Cited

U.S. PATENT DOCUMENTS

| | | | | | |
|---|---|---|---|---|---|
| 4,993,076 | A | * | 2/1991 | Dierickx | A41D 13/0158 2/2.5 |
| 5,154,416 | A | | 10/1992 | Smull et al. | |
| D340,784 | S | * | 10/1993 | Clayton | D29/101.1 |
| 5,375,836 | A | | 12/1994 | Kiser | |
| 5,640,719 | A | * | 6/1997 | Ritchie | A63B 69/0059 2/102 |
| 5,704,856 | A | | 1/1998 | Morse | |
| 5,742,947 | A | * | 4/1998 | Davis | A63B 71/12 2/455 |
| 5,950,249 | A | * | 9/1999 | Clement | A63B 71/12 2/463 |
| 5,978,961 | A | * | 11/1999 | Barker | A41D 13/015 2/2.5 |
| 6,773,366 | B2 | | 8/2004 | Gray | |
| 7,818,820 | B2 | * | 10/2010 | Tsujimoto | A63B 71/12 2/310 |
| 8,024,820 | B2 | * | 9/2011 | Weimer | A41D 13/0518 2/463 |
| 8,550,930 | B1 | | 10/2013 | Medin, III | |
| D713,997 | S | * | 9/2014 | Daugherty | D29/101.4 |
| 8,968,121 | B2 | | 3/2015 | Leggett et al. | |
| 9,440,131 | B2 | | 9/2016 | Mueller | |
| 9,687,716 | B2 | | 6/2017 | George | |
| 9,700,775 | B2 | | 7/2017 | Hamilton et al. | |
| 2002/0077223 | A1 | * | 6/2002 | Zai | A63B 71/0605 482/83 |
| 2007/0054758 | A1 | | 3/2007 | Cockrell | |
| 2017/0157483 | A1 | | 6/2017 | Wilber et al. | |

* cited by examiner

BASEBALL BATTING TRAINING AID AND METHOD

BACKGROUND OF THE INVENTION

1. Field of the Invention

The present invention relates generally to sporting/outdoor equipment, and in particular, a training aid for learning and improvement of baseball swings.

2. Description of the Related Art

When a baseball or softball player is learning to bat, and also when a regular player is returning to exercises, proper coordination of arms and hips typically needs improvement. Many devices and systems have been developed that provide visual or tactile feedback of arm, bat and hip position, but the devices that provide tactile feedback typically interfere with one or both arms during the entire swing in a manner that is undesirable. Systems that provide visual feedback, such as computer-modeled image capture and ordinary video recording do not provide immediate, tactile feedback to the player.

Therefore, it would be desirable to provide another form of device and methodology for baseball batting training.

SUMMARY OF THE INVENTION

The objective of providing a device and methodology for baseball batting training is accomplished in a baseball batting training aid. The baseball batting training aid is an apparatus that includes a vertical stop providing a surface that is aligned vertically along a chest of a batter so that the lead arm of the batter is prevented from traveling past the vertical stop by contacting the vertical stop when the batter winds up to strike a ball. The apparatus also includes a pair of braces rigidly coupled to the vertical stop and substantially perpendicular to the vertical stop so that the pair of braces cross the chest of the batter to transfer energy from the vertical stop to the chest of the batter when the lead arm of the batter contacts the vertical stop.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention includes devices for assisting training of baseball and softball batters. When a batter winds up to strike a ball, there is a tendency of batters to fold the lead arm across their chest as the bat is brought near the trailing shoulder. The lead arm is the arm corresponding to the batter's hand that is closest to the near end of the bat and that is generally the closest arm to the pitch, i.e., the arm corresponding to the hip of the batter that is turned toward the pitcher. However, to achieve the most powerful swing, it is desirable to hold the lead arm such that a space, sometimes referred to as the "box" or "barrel" is maintained between the batter's chest and the lead arm. The present invention provides a stop that prevents the lead arm from collapsing into the area that forms the box or barrel. A brace transfers energy from the stop across the batter's chest, so that if and when the stop is struck by the upper portion of the lead arm, the stop remains in place, blocking the lead arm. With practice, and ideally, the stop is not contacted at all during the swing, so that the stop acts only to prevent collapse of the "box" or "barrel" during batting practice.

Figure 1:
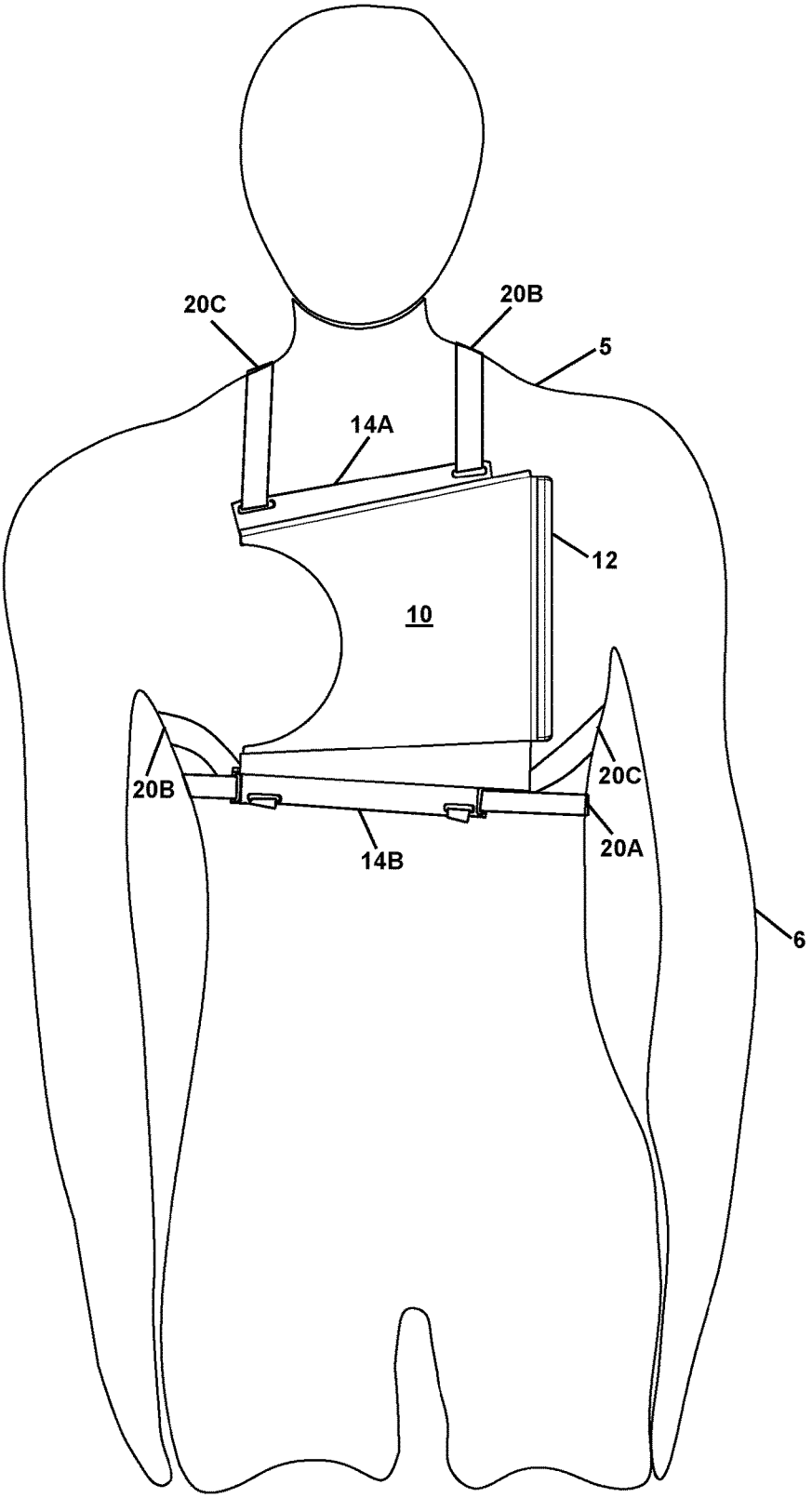
FIG. 1 is a front view of a batter 5 wearing an example batting training aid 10 as disclosed herein.

Referring now to FIG. 1, an illustrative example of a batting training aid 10 is shown in a front view, as worn by a batter 5. The illustrated configuration is for a right-handed batter, i.e., a batter 5 whose lead arm is a left arm 6 and who faces a left side of the plate (home base) while batting. In order to accommodate a left-handed batter, a mirror image of batting training aid 10 along the left-right direction is produced and worn. An adjustable waist strap 20A secures a lower portion of batting training aid 10 around a waist of batter 5 and a pair of adjustable shoulder straps 20B,20C pass over shoulders of batter 5 and cross to return to batting training aid 10 near the waist of batter 5. Batting training aid 10 is made of one or more components, including a formed front portion that can be a molded resilient plastic such as acrylonitrile butadiene styrene (ABS) or polycarbonate, or may be made from a composite material, metal or another suitable material. Batting training aid 10 may be formed by molding, casting, or in the case of units formed from sheet metal, bending. An upper brace 14A and a lower brace 14B form part of batting training aid 10 and are adjustable with respect to a vertical stop 12 provided by batting training aid 10 to align a front face of batting training aid 10 at an acute angle with respect to the chest of batter 5, as will be described in further detail below. Upper brace 14A and lower brace 14B extend across the chest of batter 5 in order to transfer energy imparted to vertical stop 12 when the left arm 6 of batter 5 contacts vertical stop 12 during windup for a batting swing.

Figure 2:
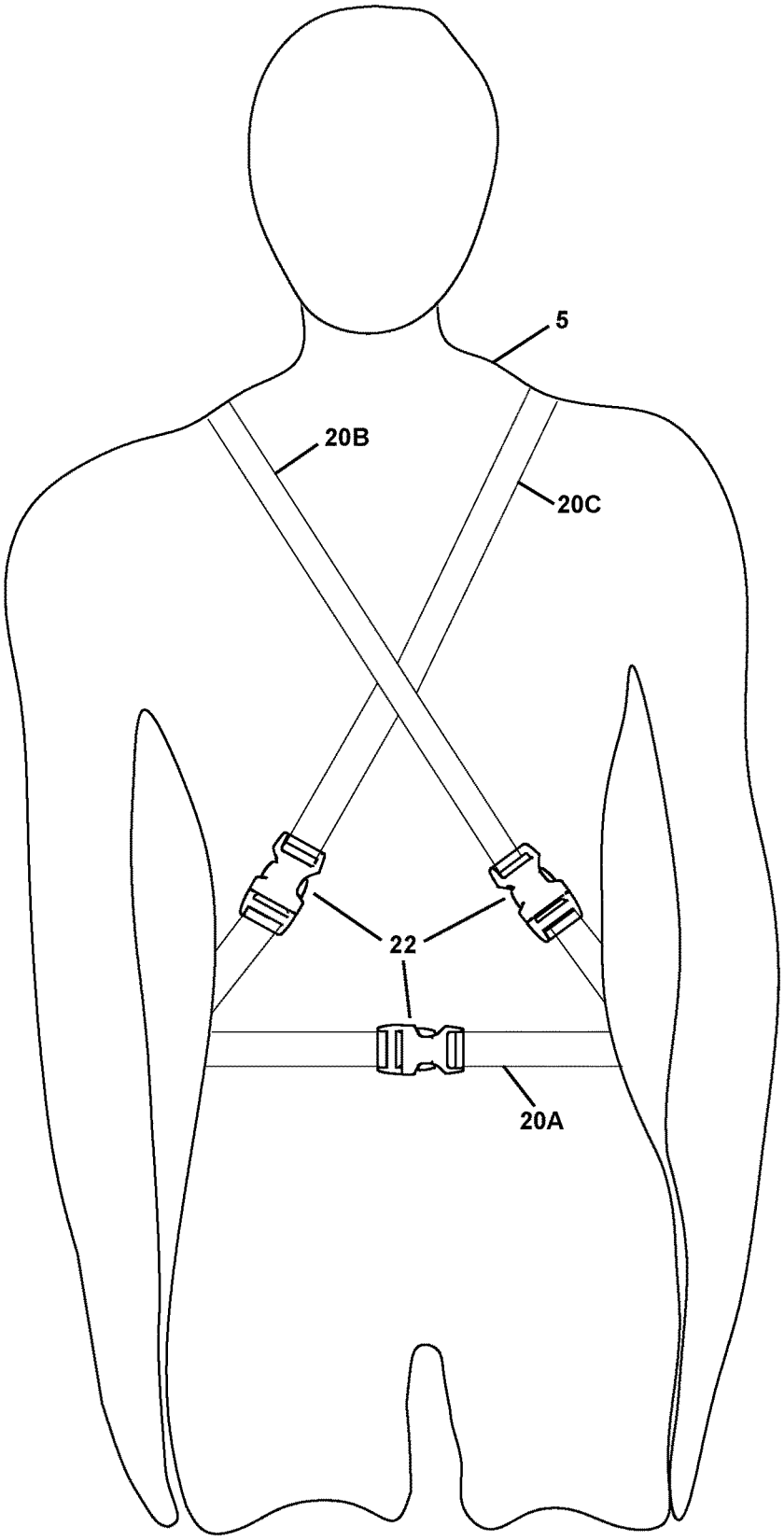
FIG. 2 is a back view of batter 5 wearing batting training aid 10 of FIG. 1.

Referring now to FIG. 2, a rear view of batter 5 is shown, with adjustable shoulder straps 20B, 20C and adjustable waist strap 20A secured by a set of releasable latches 22.

Releasable latches 22 are generally of a two-part plastic construction with a bending pass-through pathway on at least one of the parts for attachment and adjustment of a strap, as are generally used in fastening fabric straps. Adjustable shoulder straps 20B, 20C and adjustable waist strap 20A are generally made from a strong flexible woven synthetic material such as nylon or polyester, but may be another material such as cotton or plastic, as appropriate.

Figure 3A:
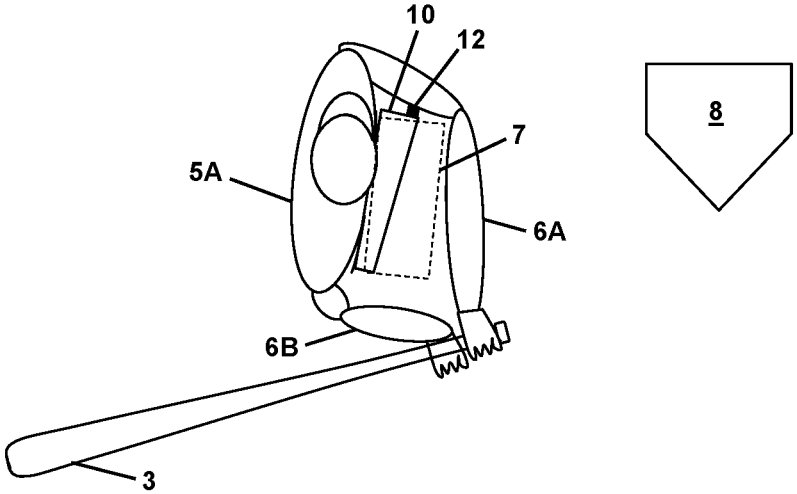
FIG. 3A is an overhead view and FIG. 3B is a front view of a batter 5A preparing to swing a bat 3 and wearing batting training aid 10 of FIGS. 1-2.
Figure 3B:
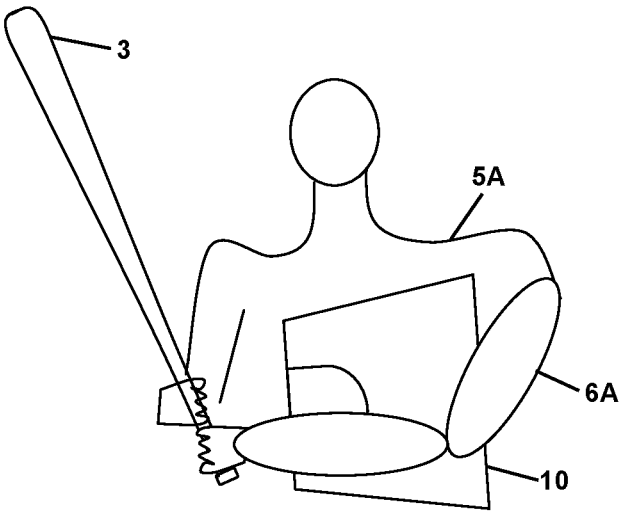
Figure 3C:
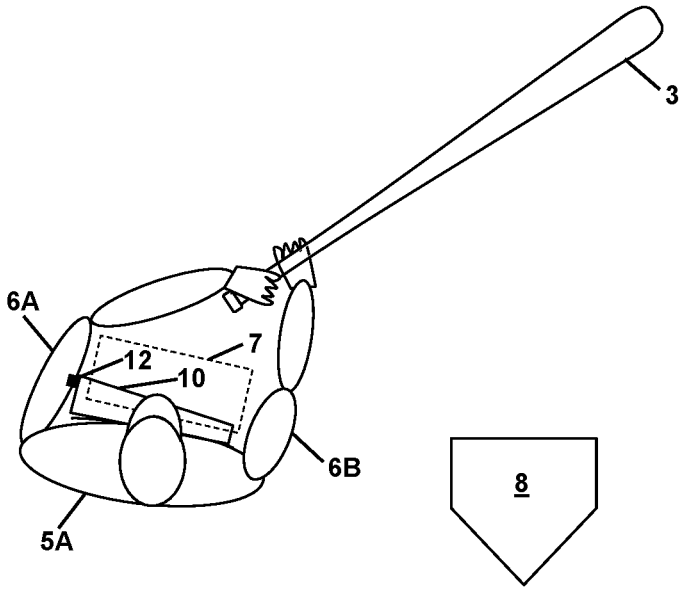
FIG. 3C is an overhead view and FIG. 3D is a side view of batter 5A completing a swing of bat 3 and wearing batting training aid 10 of FIGS. 1-2.
Figure 3D:
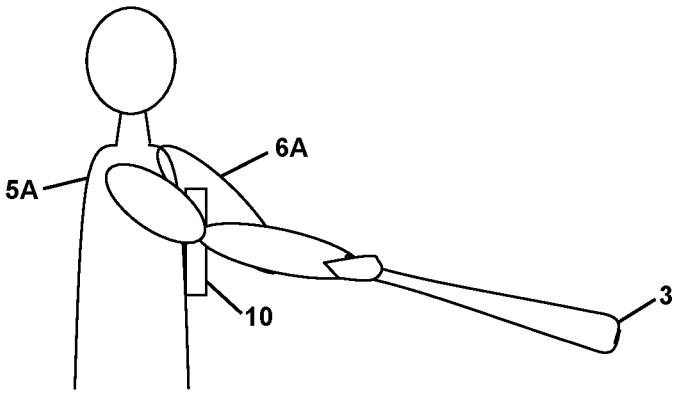

Referring now to FIGS. 3A-3D, exemplary use and operation of batting training aid 10 are illustrated. FIG. 3A shows a top view, and FIG. 3B shows a front view of a batter 5A facing a baseball plate 8 and in a wind up position ready to swing. A bat 3 is in a right-handed grip with a left arm 6A as the lead arm gripping bat 3 near the end of bat 3 and the upper portion of left arm 6A in contact with vertical stop 12 near a midpoint of an upper portion of left arm 6A, i.e. near the middle of the batter's left bicep, so that the elbow of left arm 6A is prevented from moving any farther inward across the chest of batter 5A toward bat 3, which maintains the general shape of "box" 7, which is the desired position for preparing to produce the most powerful and controlled swing of bat 3. A right arm 6B forms the other side of "box" 7. FIG. 3C shows a top view, and FIG. 3D shows a side view of batter 5A from a similar perspective as FIG. 3B, but batter 5A has turned during the swing and is facing away from baseball plate 8 toward pitcher. While vertical stop 12 does not prevent left arm 6A of batter 5A from moving further in the direction of rotation of the swing, effectively opening "box" 7, vertical stop 12 can provide tactile feedback for batter 5A to use in maintaining "box" 7 throughout the swing and at least a portion of the follow-through of the swing. With practice, and for experienced batters, left arm 6A may not contact vertical stop 12 at any time during a swing and thus serves as a limit only preventing collapse of "box" 7.

Figure 4:
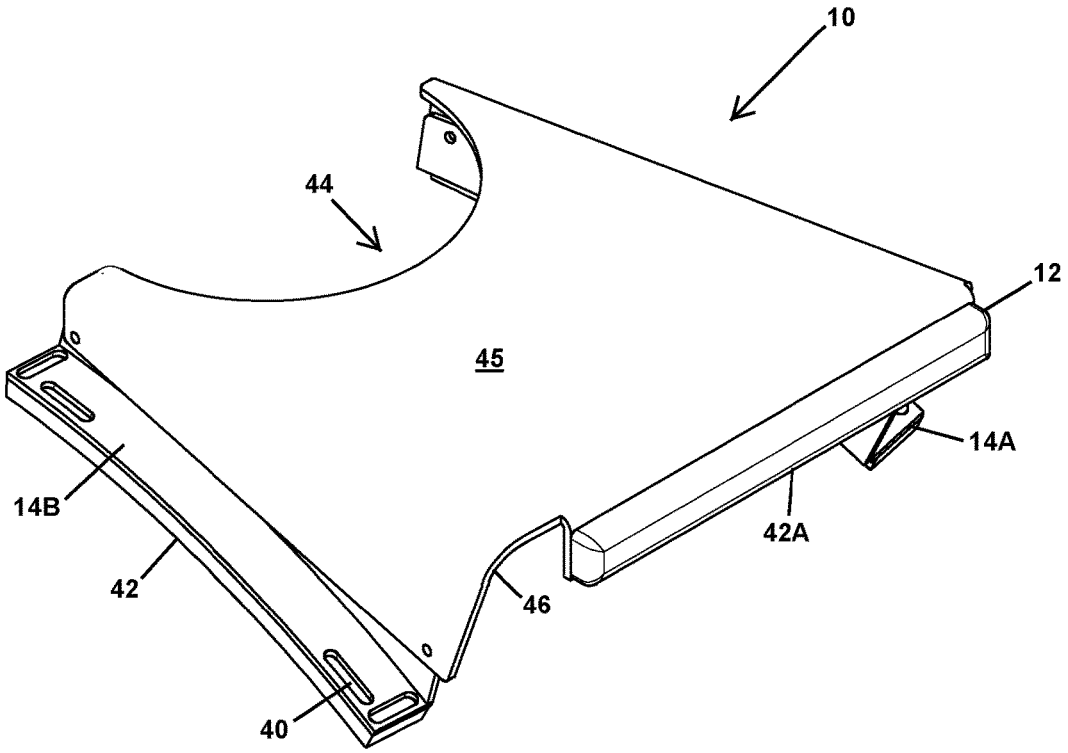
FIG. 4 is a lower front perspective view of batting training aid 10 of FIGS. 1-2.

Referring now to FIG. 4, a perspective view of batting training aid 10 is shown as an example of batting training aid 10 that provides the function and benefits of a batting training aid as disclosed and claimed herein. A front face of batting training aid 10 is provided from a formed unit 45 that curves downward according to a profile 46, which prevents having a sharp edge in a direction of travel of right arm 6B of batter 5A. Formed unit 45 defines a cut-out 44 for providing relief for the trailing arm of batter 5A, pectoral flexure and for accommodating female batters. Upper brace 14A and lower brace 14B are coupled to formed unit 45 with fasteners, in order to provide adjustment of vertical stop 12 with respect to the chest of batter 5. Upper brace 14A and lower brace 14B are padded, for example, with self-adhesive ⅜" or ½" thick foam strips 42. Vertical stop 12 is also padded with either a foam strip or rubber stop 42A, which may need to be thicker than foam strips 42. A plurality of strap slits 40 are provided for attachment of straps 20A-20C as shown in FIGS. 1-2.

Figure 5:
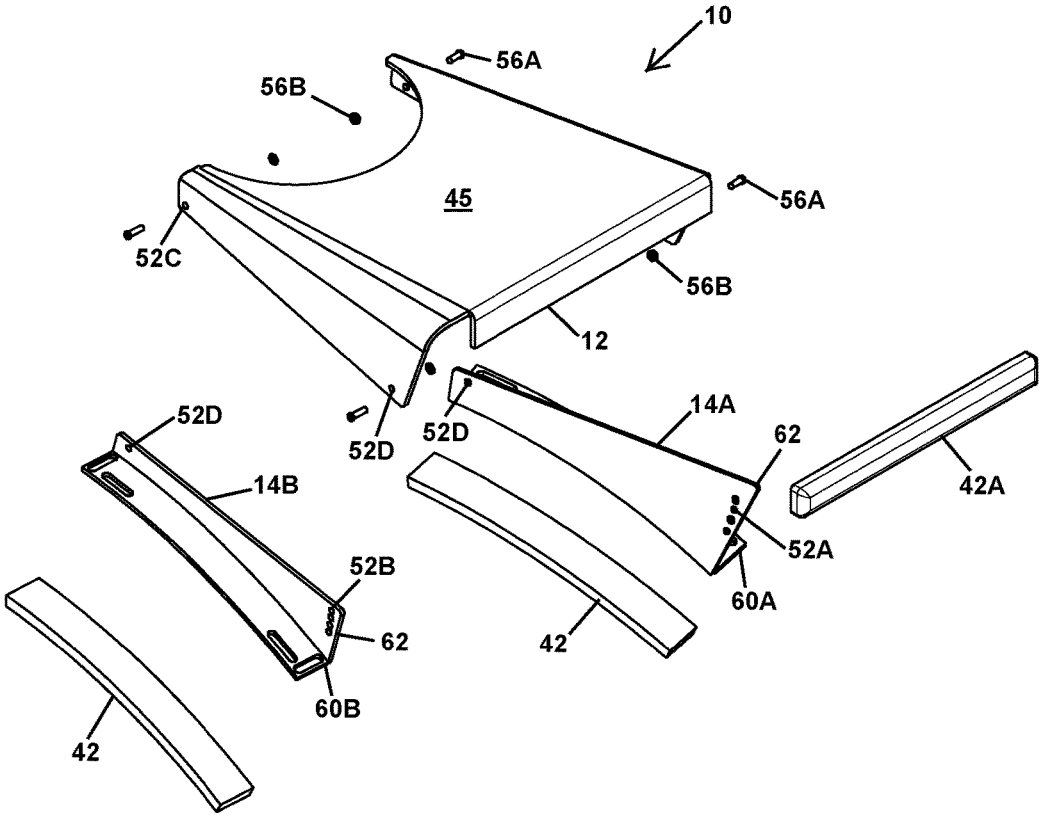
FIG. 5 is an exploded perspective view of batting training aid 10 of FIGS. 1-2.

Referring now to FIG. 5, an exploded view of batting training aid 10 is shown. Formed unit 45 attaches to upper brace 14A and lower brace 14B with fasteners 56A and 56B, which are illustrated as a bolt and nut, respectively, but which may be rivets, plugs, or other suitable fasteners. The right side of formed unit 45 has a single pivot hole 52C through each of the top and bottom side of formed unit 45 that each align with a corresponding pivot hole 52D (not visible on upper brace 14A) provided through a wall portion 62A of upper brace 14A and a wall portion 62B of lower brace 14B. Upper brace 14A includes wall portion 62A and a curved contact portion 60A that is curved to conform with the chest of a batter. Lower brace 14B includes wall portion 62B and a curved contact portion 60B that is curved to conform with the torso of a batter. The left side of formed unit 45 has a pair of holes 52D that are adjustably aligned with one of multiple holes 52A and 52B provided through upper brace 14A and lower brace 14B, respectively, providing for adjustment of a distance of vertical stop 12 from the batter's chest.

Figure 6:
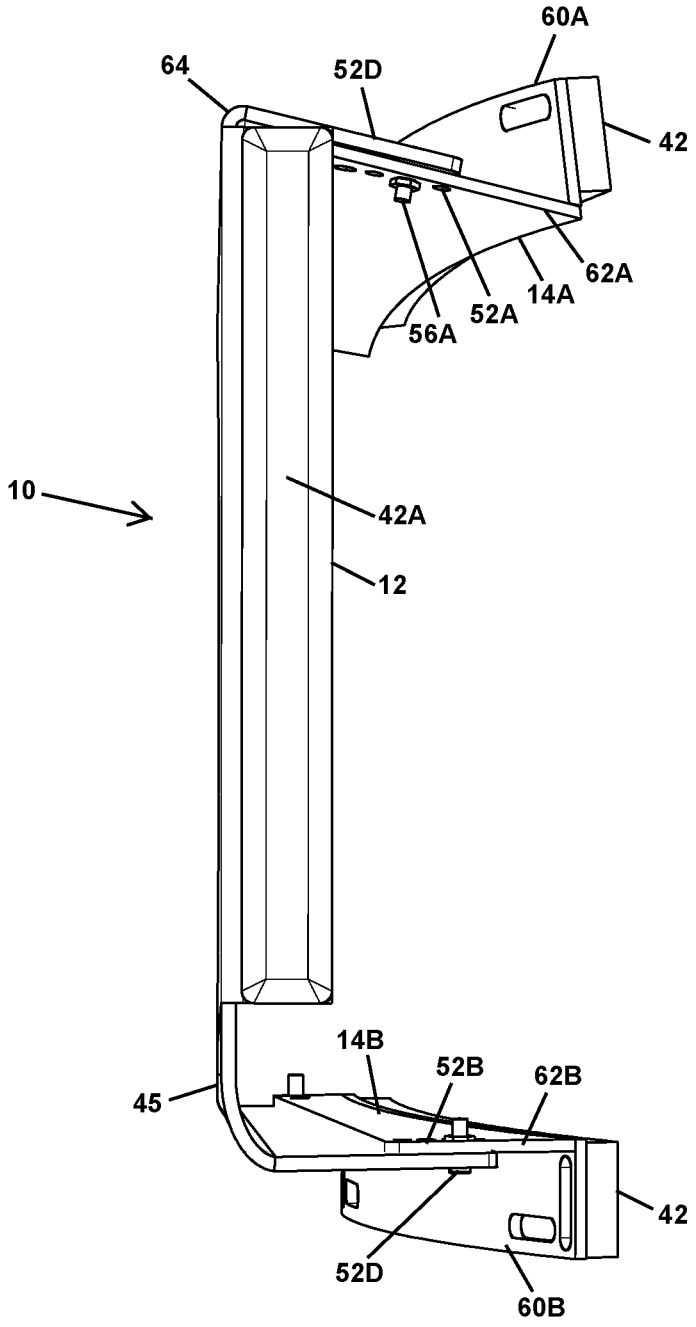
FIG. 6 is a left side view of batting training aid 10 of FIGS. 1-2.

Referring now to FIG. 6, a left side view of batting training aid 10 is shown, showing the relationship of holes 52D and multiple holes 54A and 54B. FIG. 6 further illustrates a profile of upper brace 14A, which has a wall 62A that is inclined at an acute angle, i.e., slightly less than perpendicular, e.g., 10 degrees as illustrated, with respect to a curved contact portion 60A, which extends vertical stop 12 toward the left shoulder of the batter, preventing an upper left corner 64 from being contacted by the left arm of the batter during a swing. A wall 62B of lower brace 14B is substantially perpendicular to curved contact portion 60B, which can optionally be inclined toward the top of batting training aid 10 to prevent contact with the trailing right arm of the batter.

Figure 7:
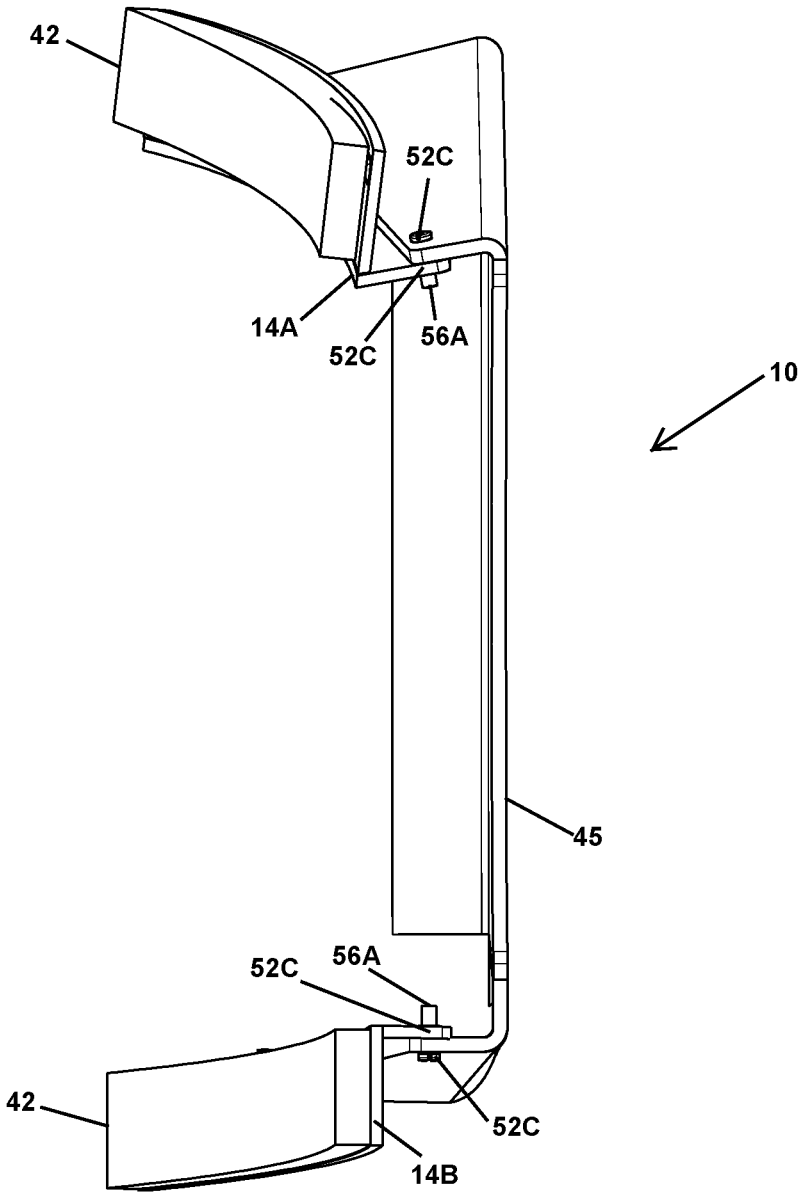
FIG. 7 is a right side view of batting training aid 10 of FIGS. 1-2.

Referring now to FIG. 7, a right side view of batting training aid 10 is shown, showing the relationship of pivot holes 52C.

Figure 8:
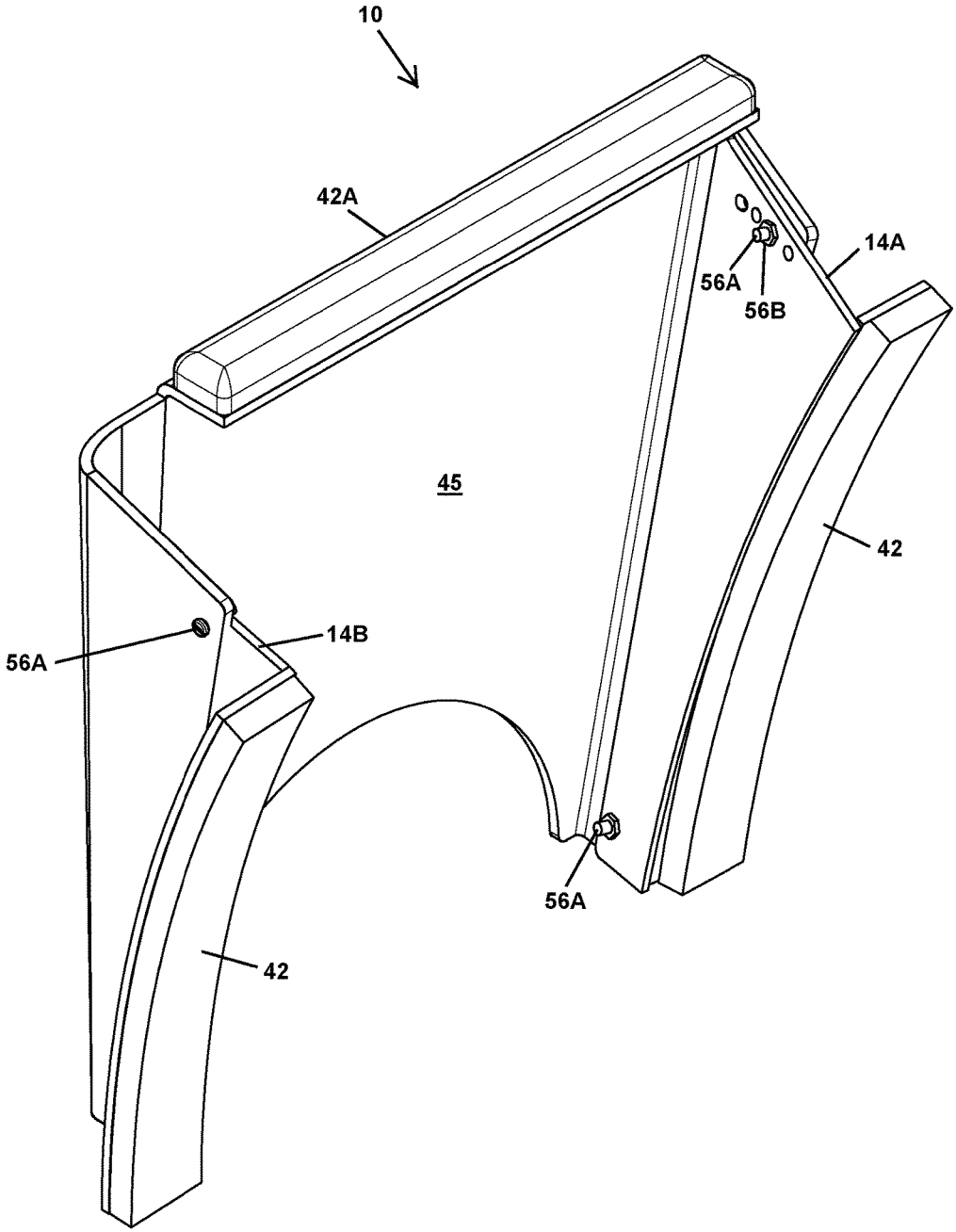
FIG. 8 is a back interior perspective view of batting training aid 10 of FIGS. 1-2.

Referring now to FIG. 8, a back perspective inside view of batting training aid 10 is shown, illustrating the curvature of curved contact portion 60A of upper brace 14A and curved contact portion 60B of lower brace 14B, which is shaped to conform to a curvature of the chest/torso of a typical batter. Different shapes may be implemented for different sizes of batting training aid 10, which can be scaled and adjusted to accommodate the size, age and gender of different batters.

Figure 9A:
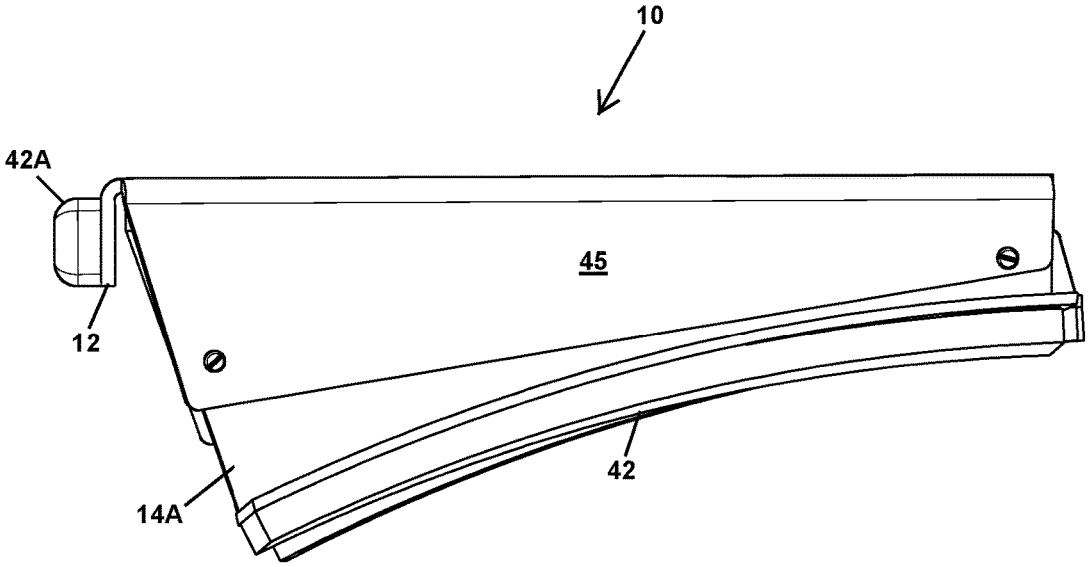
FIGS. 9A-9B are top views of batting training aid 10 of FIGS. 1-2 in different adjustment positions.
Figure 9B:
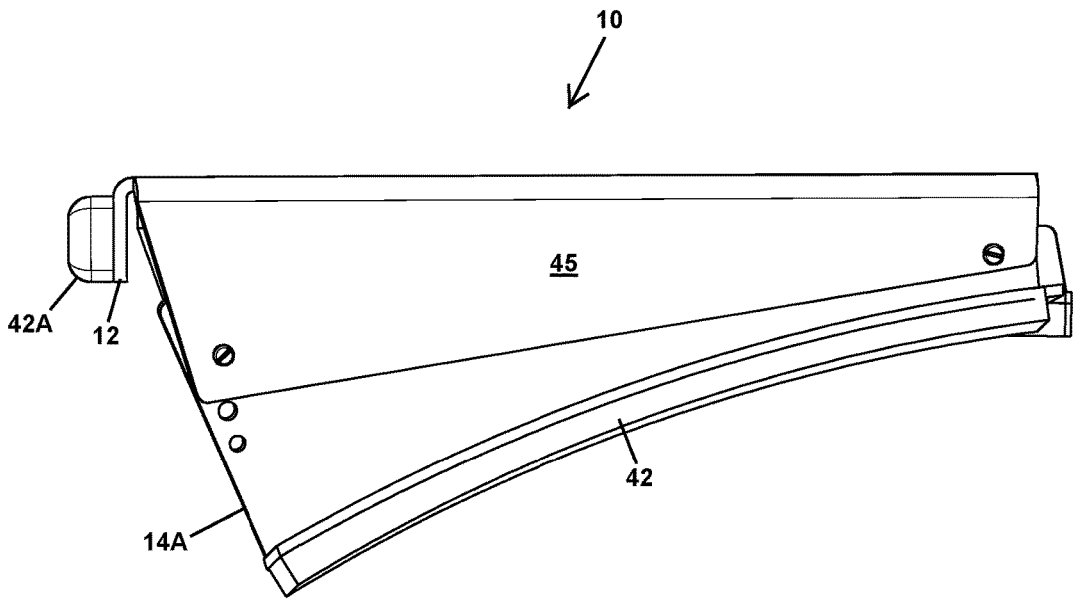

Referring now to FIGS. 9A-9B, top views of batting training aid 10 are shown. FIG. 9A shows a configuration of batting training aid 10 with upper brace 14A and lower brace 14B (not shown) adjusted to the closest position of the batter's chest. FIG. 9B shows another configuration of batting training aid 10 with upper brace 14A and lower brace 14B (not shown) adjusted farther away from the batter's chest, which relocates vertical stop 12 to make earlier contact with the batter's left arm during a swing than the configuration shown in FIG. 9A.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A baseball batting training device, comprising:

a formed unit having a vertical stop located at a side thereof, the vertical stop providing a surface that is alignable along a chest of a batter so that a lead arm of the batter is prevented from traveling past the vertical stop by contacting the vertical stop when the batter winds up to strike a ball; and a pair of braces rigidly coupled to the vertical stop and extending in a direction substantially perpendicular to the vertical stop so that the pair of braces cross the chest of the batter and the torso of the batter, respectively, for transferring energy from the vertical stop to the chest and torso of the batter when the lead arm of the batter contacts the vertical stop, wherein the pair of braces are curved to better conform to the chest and torso of the batter, wherein the vertical stop is adjustable with respect to the pair of braces so that the vertical stop is extendable away from the pair of braces and away from the chest and torso of the batter and dimensioned to contact an upper portion of the lead arm of the batter near a midpoint of the upper portion of the lead arm of the batter, wherein the formed unit has a front face disposed at an acute angle with respect to surfaces of the pair of braces that contact the chest and torso of the batter and extending from a direction away from a trailing arm of the batter so that a first depth of the front face away from the chest of the batter is less near the lead arm than a second depth of the front face at the vertical stop, wherein the pair of braces each have a curved contact portion for contacting the chest and torso, respectively, of the batter along a length of the curved contact portion and a horizontal wall extending from the pair of braces in a direction perpendicular to the curved contact portion that couples the vertical stop to the pair of braces, and wherein the formed unit further includes a top face and a bottom face extending from the front face and aligned substantially parallel to a corresponding one of vertical walls, wherein the vertical walls are coupled to a corresponding one of the top face and the bottom face with a fastening mechanism, wherein at least one of the horizontal walls of the pair of braces or the top face and the bottom face of the formed unit include holes or indentations to receive a corresponding fastener or protrusion to provide an adjustable stop for setting the acute angle between the front face of the formed unit and the surfaces of the pair of braces that contact the chest and torso of the batter.

2. A method of training a baseball batter, comprising:

securing a training device to a chest of the batter, wherein the training device comprises a first brace comprising a first curved contact portion for extending across a chest of a batter at an upper position, so that a first rear surface of the first curved contact portion is in contact with the chest of the batter across a length of the first curved contact portion when the baseball batting training device is worn by the batter, and a first wall portion having a first end attached to a first front surface of the first curved contact portion and extending forward from the first front surface of the first curved contact portion, a second brace comprising a second curved contact portion for extending across a torso of the batter at a lower position lower than the upper position, so that a second rear surface of the second curved contact portion is in contact with the torso of the batter across a length of the second curved contact portion when the baseball batting training device is worn by the batter, and a second wall portion having a first end attached to a second front surface of the second curved contact portion and extending forward from the second front surface of the second curved contact portion, a plurality of straps attached to at least one of the first brace and the second brace for securing the baseball batting training device across the chest and torso of the batter, and a formed unit having an upper edge mechanically coupled to the first wall portion of the first brace at a second end of the first wall portion of the first brace and to the second wall portion of the second brace at a second end of the second wall portion of the second brace, wherein the formed unit is supported in front of the chest of the batter by the first brace and the second brace when the baseball batting training device is worn by the batter;

the batter preparing to swing the bat by retracting the bat toward a trailing shoulder of the batter;

stopping a lead arm of the batter from traveling past a predetermined point along the chest of the batter by contact of an upper portion of the lead arm of the batter near a midpoint of the upper portion of the lead arm of the batter with a vertical stop forming part of the formed unit and extending at least between the upper edge and the lower edge of the formed unit at a first side of the formed unit, wherein placement of the first brace and the second brace along the chest of the batter aligns the vertical stop vertically along a chest of the batter, and wherein the formed unit is dimensioned to locate the vertical stop to contact the lead arm of the batter when the bat is retracted toward the trailing shoulder of the batter; and transferring energy from the contact with the vertical stop through the first brace and the second brace to the chest and torso of the batter when the lead arm of the batter contacts the vertical stop.

3. The method of claim 2, wherein the stopping is performed with the vertical stop extending above at least a portion of the first elongate portion of the first brace to approach a lead shoulder of the batter.

4. The method of claim 2, further comprising adjusting the vertical stop with respect to the pair of braces so that the vertical stop extends away from the pair of braces and away from the chest of the batter.

5. The method of claim 2, wherein the formed unit has a front face disposed at an acute angle with respect to the first rear surface of the first curved contact portion of the first brace and the second rear surface of the second curved contact portion of the second brace and extending from a direction away from a trailing arm of the batter so that a first depth of the front face away from the chest of the batter is less near the lead arm than a second depth of the front face at the vertical stop.

6. The method of claim 5, wherein the formed unit further includes a planar front face, a top edge portion that extends from the front face and curves rearward according to a profile of the formed unit and a bottom edge portion that curves rearward according to the profile of the formed unit, wherein the top edge portion extends to lie substantially parallel with the first wall portion of the first brace, and wherein the bottom edge portion extends to lie substantially parallel with the second wall portion of the second brace, and wherein the method further comprises attaching the formed unit to the first wall portion of the first brace along the top edge portion and attaching the formed unit to the second wall portion of the second brace along the bottom edge portion with a plurality of fasteners.

7. The method of claim 6, further comprising adjusting the acute angle between the front face of the formed unit and the first brace and the second brace, wherein at least one of the horizontal walls of the pair of braces or the top face and the bottom face of the formed unit include holes or indentations to receive a corresponding face of the formed unit and the surfaces of the pair of braces that contact the chest of the batter.

8. The method of claim 6, wherein the stopping is performed with the top face of the formed unit extending at an acute angle backward from the front face of the formed unit, whereby the vertical stop provided by the side wall extends above the uppermost one of the pair of braces to approach a lead shoulder of the batter.

9. The method of claim 5, further comprising providing relief between the batter and the formed unit by providing a cutout region in the front face of the formed unit extending from a side of the formed unit opposite the vertical stop substantially toward a center of the front face.

10. A baseball batting training device, comprising:

a first brace comprising a first curved contact portion for extending across a chest of a batter at an upper position, so that a first rear surface of the first curved contact portion is in contact with the chest of the batter across a length of the first curved contact portion when the baseball batting training device is worn by the batter, and a first wall portion having a first end attached to a first front surface of the first curved contact portion and extending forward from the first front surface of the first curved contact portion;

a second brace comprising a second curved contact portion for extending across a torso of the batter at a lower position lower than the upper position, so that a second rear surface of the second curved contact portion is in contact with the torso of the batter across a length of the second curved contact portion when the baseball batting training device is worn by the batter, and a second wall portion having a first end attached to a second front surface of the second curved contact portion and extending forward from the second front surface of the second curved contact portion;

a plurality of straps attached to at least one of the first brace and the second brace for securing the baseball batting training device across the chest and torso of the batter; and a formed unit having an upper edge mechanically coupled to the first wall portion of the first brace at a second end of the first wall portion of the first brace and a lower edge mechanically coupled to the second wall portion of the second brace at a second end of the second wall portion of the second brace, wherein the formed unit is supported in front of the chest of the batter by the first brace and the second brace when the baseball batting training device is worn by the batter, wherein the formed unit includes a vertical stop extending at least between the upper edge and the lower edge of the formed unit at a first side of the formed unit, wherein placement of the first brace and the second brace along the chest of the batter aligns the vertical stop vertically along the chest of the batter and the formed unit is dimensioned to locate the vertical stop at a position extended in front of the chest of the batter so that a lead arm of the batter is prevented from traveling past the vertical stop by contacting the vertical stop with an upper portion of a lead arm of the batter near a midpoint of the upper portion of the lead arm when the batter winds up to strike a ball, and wherein the formed unit transfers force from the lead arm through the first brace and the second brace to the chest and torso of the batter when the lead arm of the batter contacts the vertical stop.

11. The baseball batting training device of claim 10, wherein the formed unit comprises a planar front face, a top edge portion that extends from the front face and curves rearward according to a profile of the formed unit and a bottom edge portion that curves rearward according to the profile of the formed unit, wherein the top edge portion extends to lie substantially parallel with the first wall portion of the first brace, and wherein the bottom edge portion extends to lie substantially parallel with the second wall portion of the second brace, and wherein the baseball batting training device further comprises a plurality of fasteners for attaching the formed unit to the first wall portion of the first brace along the top edge portion and attaching the formed unit to the second wall portion of the second brace along the bottom edge portion.

12. The baseball batting training device of claim 11, wherein the formed unit is a formed sheet metal or thin molded plastic structure defining a void extending between the first brace and the second brace and behind the front face of the formed unit.

13. The baseball batting training device of claim 11, wherein at least one of the first wall portion of the first brace and the second wall portion of the second brace, or the top edge portion of the formed unit and the bottom edge portion of the formed unit, include holes or indentations to receive a corresponding fastener or protrusion to provide an adjustable stop for setting an angle between the formed unit and the first brace and the second brace.

14. The baseball batting training device of claim 11, wherein the first wall portion or the top edge portion include a first plurality of holes and wherein the second wall portion or the bottom edge portion include a second plurality of holes, wherein at least some of the plurality of fasteners secure the formed unit to the first brace and the second brace through the first and second plurality of holes, whereby the at least some of the plurality of fasteners can moved among the first and second plurality of holes adjust a distance between an axis of the vertical stop and the chest and torso of the batter and tightened to secure the vertical stop in an adjusted position.

15. The baseball batting training device of claim 11, wherein the first wall portion of the first brace extend both forward and upward from the first front surface of the first curved contact portion, so that the vertical stop extends above at least a portion of the first curved contact portion of the first brace.

16. The baseball batting training device of claim 11, wherein the front face of the formed unit defines a cutout region extending from a side of the formed unit opposite the vertical stop substantially toward a center of the front face of the formed unit.

17. The baseball training device of claim 10, wherein the first rear surface of the first curved contact portion of the first brace and the second rear surface of the second curved contact portion of the second brace are padded.

18. The baseball training device of claim 10, wherein the vertical stop is padded.

* * * * *